US011542071B2

(12) United States Patent
Chen

(10) Patent No.: US 11,542,071 B2
(45) Date of Patent: Jan. 3, 2023

(54) SNAP ACTION CONTAINER

(71) Applicant: Changsha Yuwen Network Technology Co., Ltd., Changsha (CN)

(72) Inventor: Junyuan Chen, Changsha (CN)

(73) Assignee: HAIKOU LILI INVESTMENT CO., LTD., Haikou (CN)

( * ) Notice: Subject to any disclaimer, the term of this patent is extended or adjusted under 35 U.S.C. 154(b) by 0 days.

(21) Appl. No.: 17/377,527

(22) Filed: Jul. 16, 2021

(65) Prior Publication Data

US 2022/0388731 A1 Dec. 8, 2022

(30) Foreign Application Priority Data

Jun. 4, 2021 (CN) ..... 202121252671.9

(51) Int. Cl.

| | |
|---|---|
| ***B65D 43/22*** | (2006.01) |
| ***B65D 43/16*** | (2006.01) |
| ***B65D 43/24*** | (2006.01) |

(52) U.S. Cl.

CPC ..... *B65D 43/22* (2013.01); *B65D 43/169* (2013.01); *B65D 43/24* (2013.01); *B65D 2543/0049* (2013.01); *B65D 2543/0062* (2013.01); *B65D 2543/00194* (2013.01); *B65D 2543/00759* (2013.01)

(58) Field of Classification Search

CPC ..... B65D 47/0871; B65D 47/0828; B65D 43/24; E05D 11/10

USPC .... 220/823, 827, 829, 828, 830, 254.5, 264, 220/838

See application file for complete search history.

(56) References Cited

U.S. PATENT DOCUMENTS

| | | | | |
|---|---|---|---|---|
| 2002/0047011 A1* | 4/2002 | Lee | B65D 43/24 | 220/823 |
| 2005/0023284 A1* | 2/2005 | Heiberg | B65D 43/164 | 220/827 |
| 2016/0200485 A1* | 7/2016 | Quinones | B65D 43/0225 | 220/254.5 |

* cited by examiner

*Primary Examiner* — Jeffrey R Allen

(74) *Attorney, Agent, or Firm* — IPro, PLLC

(57) ABSTRACT

A snap action container includes: a cover plate and a container body; wherein the cover plate is rotatably connected to the container body by a rotation shaft, and covered on the container body; an elastomer receiving chamber is arranged at a position, corresponding to the rotation shaft, on the container body, an elastomer being inclinedly disposed in the elastomer receiving chamber, and one end of the elastomer being abutted against the rotation shaft; and when the cover plate is covered on the container body, the cover plate drives the rotation shaft to rotate, such that the rotation shaft presses against the elastomer to cause the elastomer to be subjected to elastic deformation.

13 Claims, 5 Drawing Sheets

SNAP ACTION CONTAINER

CROSS-REFERENCE TO RELATED APPLICATIONS

This application claims priority to Chinese Patent Application No. 202121252671.9, filed with the Chinese Patent Office on Jun. 4, 2021, titled "SNAP ACTION CONTAINER", the entire contents of which are incorporated herein by reference.

TECHNICAL FIELD

Embodiments of the present disclosure relate to the technical field of container structures, and in particular, relate to a snap action container.

BACKGROUND

At present, snap action containers are commonly used, especially in the field of medicines, which are generally used to store medicines. The snap action containers are welcomed in the market due to its convenient use.

During study, the inventors of the present disclosure have found that the conventional snap action container has a complicated structure. Different parts of the container need to be assembled in a complicated process. Manufacture of the container is inconvenient. In addition, the conventional snap action container has a short life time. After use of a period of time, the elastic parts may be aged and thus the elasticity is poor.

SUMMARY

An embodiment of the present application provides a snap action container. The snap action container includes: a cover plate and a container body; wherein the cover plate is rotatably connected to the container body by a rotation shaft, and covered on the container body;

an elastomer receiving chamber is arranged at a position, corresponding to the rotation shaft, on the container body, an elastomer being inclinedly disposed in the elastomer receiving chamber, and one end of the elastomer being abutted against the rotation shaft; and when the cover plate is covered on the container body, the cover plate drives the rotation shaft to rotate, such that the rotation shaft presses against the elastomer to cause the elastomer to be subjected to elastic deformation.

BRIEF DESCRIPTION OF THE DRAWINGS

By reading the detailed description of preferred embodiments hereinafter, various other advantages and beneficial effects become clear and apparent for persons of ordinary skill in the art. The accompanying drawings are merely for illustrating the preferred embodiments, but shall not be construed as limiting the present disclosure. In all the accompanying drawings, like reference signs denote like parts. In the drawings.

REFERENCE NUMERALS AND DENOTATIONS THEREOF

100—cover plate; 102—rotation shaft; 1022—first arc surface; 1024—second arch surface; 104—snap tongue; 1041—first snap tab; 1042—second snap tab; 106—pressing strip; 200—container body; 202—elastomer receiving chamber; 204—receiving groove; 2041—baffle; 2043—protrusion; 206—snap plate receiving chamber; 208—snap plate; 2081—first snap block; 2082—second snap block; and 300—elastomer.

DETAILED DESCRIPTION

The embodiments containing the technical solutions of the present disclosure are described in detail with reference to the accompanying drawings. The embodiments hereinafter are only used to clearly describe the technical solutions of the present disclosure. Therefore, these embodiments are only used as examples, but are not intended to limit the protection scope of the present disclosure.

During study, the inventors of the present disclosure have found that the conventional snap action container has a complicated structure, the mold for manufacturing the container is complicated. In addition, complicated manual assembling operations are needed. Further, since the elastomer is easily to age or is in an elastic state for a long time, the elasticity is poor, and thus when the container is opened, release or shaking may easily occur. The snap action container according to the embodiments of the present disclosure is applicable to accommodation of medicines, foods, and the like commonly used articles. The structure is simple, the mounting is convenient, and the elasticity is long lasting.

Figure 1:
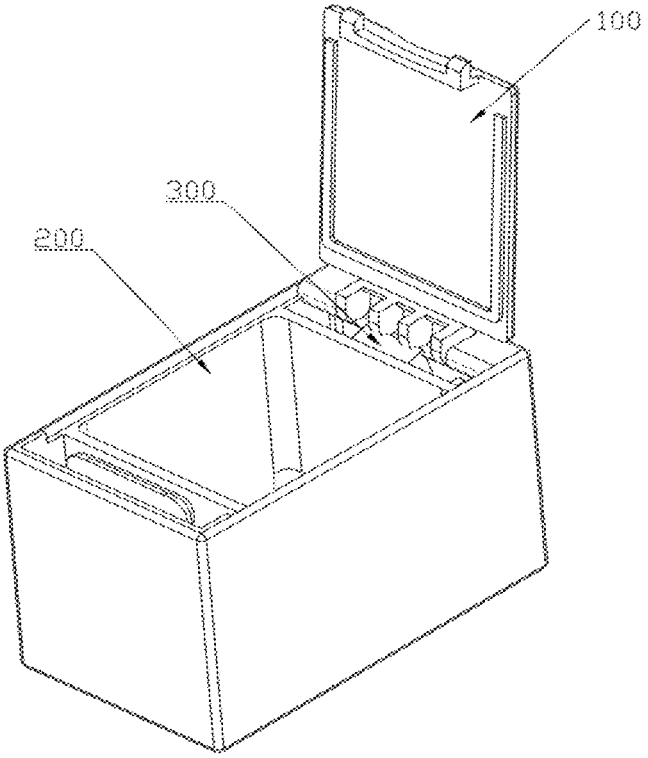
FIG. 1 is a perspective view of a snap action container according to an embodiment of the present disclosure.

FIG. 1 illustrates a perspective view of a snap action container according to an embodiment of the present disclosure. The snap action container includes a cover plate 100, a container body 200, and an elastomer 300. The cover plate 100 is rotatably arranged on a side of the container body, and is rotatable about a rotation shaft. The container body 200 is provided with an article receiving chamber, and the cover plate is covered over the article receiving chamber on the container body. An elastomer receiving chamber is arranged at a position, adjacent to the article receiving chamber, on a side of the container body 200. An elastomer 300 is disposed in the elastomer receiving chamber. The elastomer 300 is configured to supply an elastic force to the cover plate 100, such that the cover plate 100 is capable of conveniently rebounding.

Figure 2:
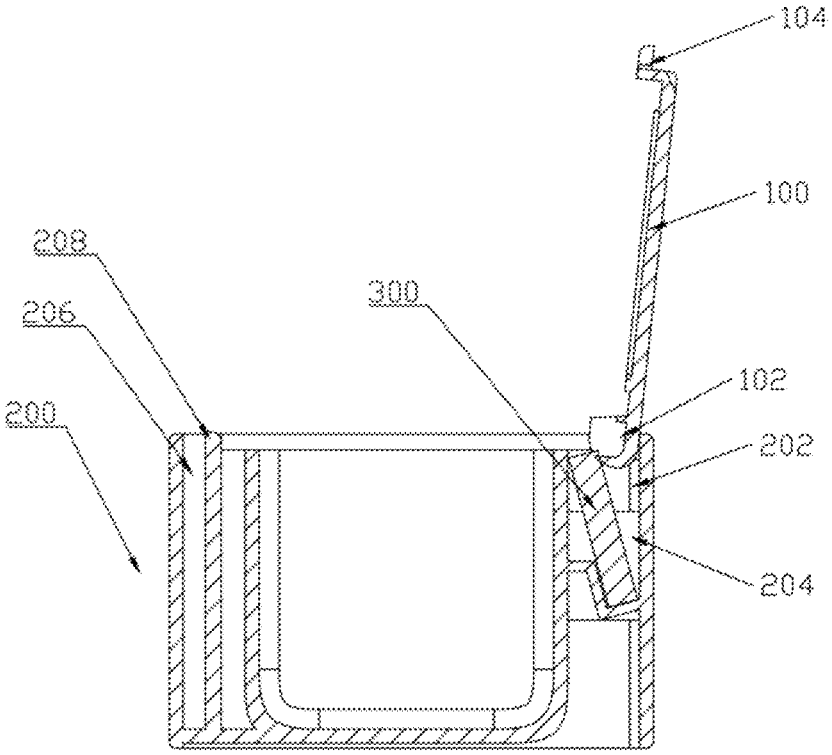
FIG. 2 is a front sectional view of a snap action container according to an embodiment of the present disclosure.
Figure 3:
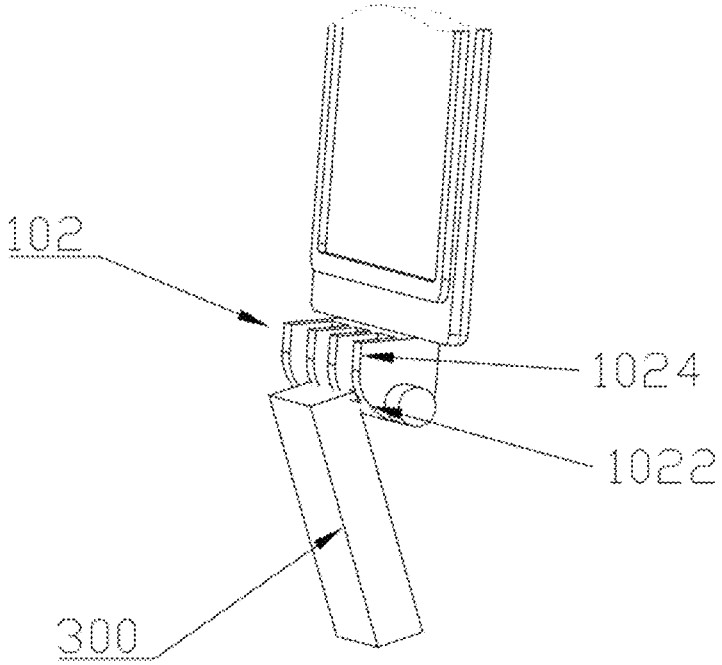
FIG. 3 is a schematic view of combination of a rotation shaft and an elastomer according to an embodiment of the present disclosure.

Specifically, as illustrated in FIG. 2, FIG. 3 illustrates a front sectional view of a snap action container according to an embodiment of the present disclosure. The cover plate 100 is rotatably connected to the container body 200 by a rotation shaft 102, and is covered on the container body 200. The rotation shaft 102 is arranged at one end of the cover plate 100, and is engaged with the container body 200, such that the cover plate 100 is rotatably connected to the container body 200. An elastomer receiving chamber 202 is arranged at a position, corresponding to the rotation shaft 102, on the container body 200. An elastomer 300 is inclinedly disposed in the elastomer receiving chamber 202. One end of the elastomer 300 is abutted against the rotation shaft 102. As seen from FIG. 2, the elastomer receiving chamber 202 is arranged at one end of the container body 200, and is spaced apart from the article receiving chamber. The rotation shaft 102 is arranged at an opening of the elastomer receiving chamber 202. When the cover plate 100 is covered on the container body 200, the cover plate 100 drives the rotation shaft 102 to rotate, such that the rotation shaft 102 presses against the elastomer 300 to cause the elastomer 300 to be subjected to elastic deformation. During opening of the cover plate 100, the elastomer 300 presses the rotation shaft 102 by an elastic force, such that the rotation shaft 102 drives the cover plate 100 to rotate, thereby easily opening the cover plate 100. In an opened state, the elastomer 300 further fixes the cover plate 100 by an elastic force, thereby preventing the cover plate from shaking. Preferably, the elastomer is a silica gel strip made of a silica gel material, or may be a metal elastic sheet or other elastic member, which is not limited herein.

As known from the above embodiments, in the snap action container according to the embodiments of the present disclosure, the elastomer receiving chamber is arranged at one end of the container body, the elastomer is inclinedly placed into the elastomer receiving chamber, and one end of the elastomer is abutted against the rotation shaft of the cover plate. The structure is very simple, and the elastic force is strong. During mounting, the assembling of the container is achieved only by placing the elastomer into the elastomer receiving chamber, and then mounting the cover plate on the container body. In addition, replacement of the elastomer is very simple. Further, since the elastomer is placed into the receiving chamber, in an opened state, the elastomer is in a release state, which prolongs life time of the elastomer.

Further, to bring the elastic effect of the elastomer into full play, as illustrated in FIG. 3, in an embodiment of the present disclosure, a rotation surface of the rotation shaft 102 is specially designed, such that the rotation shaft 102 includes a first arc surface 1022 and a second arc surface 1024. The first arc surface 1022 is smoothly connected to the second arc surface 1024. A rotation radius of the second arc surface 1024 is greater than a rotation radius of the first arc surface 1022. When the cover plate 100 is covered on the container body 200, the first arc surface 1022 and the second arc surface 1024 of the rotation shaft 100 are successively in contact with the elastomer 300, and cause a progressively increasing pressing force against the elastomer 300. In an opened state, the rotation shaft 102 is in contact with a surface at one end of the elastomer 300 by the first arc surface 1022. In this case, since the rotation radius of the first arc surface 1022 is small, the rotation shaft 102 exerts a small force against the elastomer 300. When the cover plate 100 drives the rotation shaft 102 to rotate, the elastomer 300 is first in contact with the first arc surface 1022, and is then in contact with the second arc surface 1024, such that the elastomer 300 is subjected to a progressively increasing force, and such that the cover plate 100 is subjected to an ever increasing elastic force, thereby increasing the elastic force of the cover plate. Nevertheless, the arc surface of the rotation shaft may also be designed in other forms. For example, the arc surface of the rotation shaft may be defined to a plurality of different arc surfaces, such that a more uniformly increasing force is caused against the elastomer during rotation. The design principle is the same as that in the solution according to the present disclosure, which is not described herein any further.

Further, for better disposing the elastomer and preventing the elastomer from being shifted or shaking during use, an embodiment of the present disclosure further provides another snap action container, still as illustrated in FIG. 2. As illustrated in FIG. 2, a receiving groove 204 is inclinedly arranged in the elastomer receiving chamber 202. A side wall on one side of the receiving groove 204 is a side wall of the elastomer receiving chamber 202, and a side wall on the other side of the receiving groove 204 is inclinedly arranged relative to the side wall of the elastomer receiving chamber 202, such that the elastomer 300 is inclinedly received in the receiving groove 204. One end of the elastomer 300 is arranged in the receiving groove 204, and the other end of the elastomer 300 is abutted against the rotation shaft 102. Since the receiving groove 204 is inclinedly arranged, when the elastomer 300 is disposed in the receiving groove, the elastomer 300 may be naturally inclinedly arranged and naturally in contact with the arc surface of the rotation shaft. This prevents the problem of a poor and insufficient elastic force caused by improper placement.

Further, an arrangement position of the receiving groove 204 is closely related to an inclination angle of the elastomer 300, and is also related to a length of the elastomer. Generally, an inclination angle of the elastomer relative to a bottom of the receiving groove is in a range of 45 degrees to 75 degrees. When the inclination angle is too small, a surface of the elastomer is approximately parallel to a rotation arc surface of the rotation shaft 102, and an over-small elastic force may be exerted. When the inclination angle is too large, for example, approximately 90 degrees, over-coupling may be caused between the rotation shaft and the elastomer, such that jamming is caused and no elastic force is exerted to the rotation shaft. Therefore, the inclination angle of the receiving groove may be defined according to the actual needs during use, to achieve an optimal effect. Preferably, the bottom of the receiving groove may be arranged at a middle position of the elastomer receiving chamber.

Figure 4:
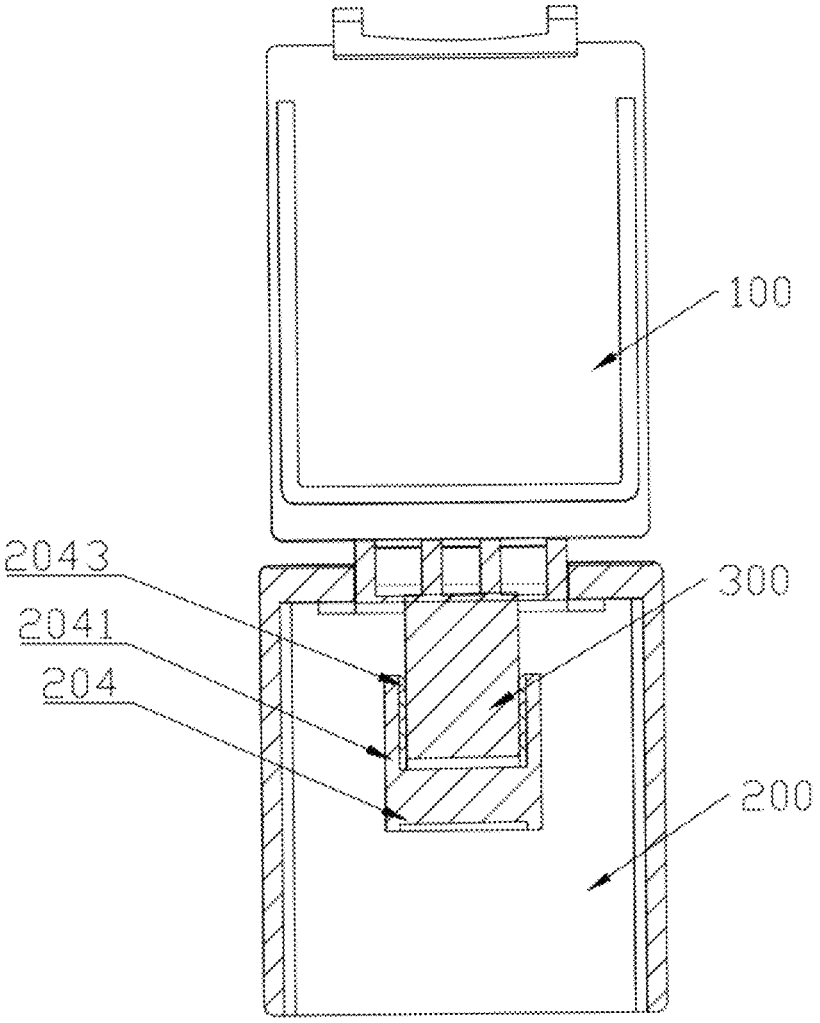
FIG. 4 is a side sectional view of a snap action container according to an embodiment of the present disclosure.

Further, as illustrated in FIG. 4, for the sake of preventing the elastomer from shaking during use, in an embodiment of the present disclosure, a baffle 2041 is arranged on each of two sides of the receiving groove 204 to stop the elastomer 300 and prevent the elastomer 300 from shifting towards the two sides. Preferably, a spacing between the baffles 2041 is equal to a width of the elastomer 300, such that the elastomer is just clamped and held, thereby achieving a better restrain effect. Nevertheless, since the elastomer has elasticity, the spacing between the baffles may also be defined to be slightly smaller than the width of the elastomer, such that the elastomer is better clamped and held. Further, as illustrated in FIG. 4, a plurality of protrusions 2043 are arranged in an inner wall of the baffle 2041. When the elastomer 300 is placed, the protrusions are capable of pressing the elastomer, and thus better restraining and clamping and holding the elastomer.

Further, since when the cover plate 100 is in an opened state, a slit is defined between the rotation shaft 102 and the elastomer receiving chamber 202, to prevent the elastomer 300 from being falling off in a case where the snap action container is inverted, and to better cause the cover plate 100 to be subjected to elastic pressing by the elastomer 300 in the opened state, in an embodiment of the present disclosure, a distance from the first arc surface 1022 of the rotation shaft 102 to a side inner wall of the elastomer receiving chamber 202 is defined to be not greater than a thickness of the elastomer 300. In this way, the elastomer may not fall off from the slit, thereby achieving a better restrain effect.

Further, for better cooperation with the elastomer 300 such that the snap action container is conveniently engaged during use, an embodiment of the present disclosure further provides a snap action container, still as illustrated in FIG. 2. In this embodiment, a snap tongue 104 is arranged at one end of the cover plate 100 of the snap action container, and a snap plate receiving chamber 206 is arranged at a position, corresponding to the snap tongue 104, on the container body 200. A snap plate 208 is arranged in the snap plate receiving chamber. The snap plate 208 is elastic. When the cover plate 100 is covered on the container body 200, the snap tongue 104 is engaged with the snap plate 208, and is configured to snap the cover plate 100 to the container body 200. The snap plate receiving chamber 206 and the elastomer receiving chamber 202 are respectively arranged on two sides of the container body 200, and an article receiving chamber is arranged in a middle portion of the container body 200. During use, when a user presses the cover plate 100, the cover plate 100 drives the rotation shaft 102 to rotate to press against the elastomer 300. The snap tongue 104 is engaged with the snap plate 208, such that the cover plate 100 is fixed to the container body 200, and the elastomer 300 is in a pressed state. When the user rotates the snap plate 208, the snap plate 208 is separated from the snap tongue 104. Due to the effect of an elastic force of the elastomer 300, the cover plate 100 is easily rebounded and enters an opened state.

Figure 5:
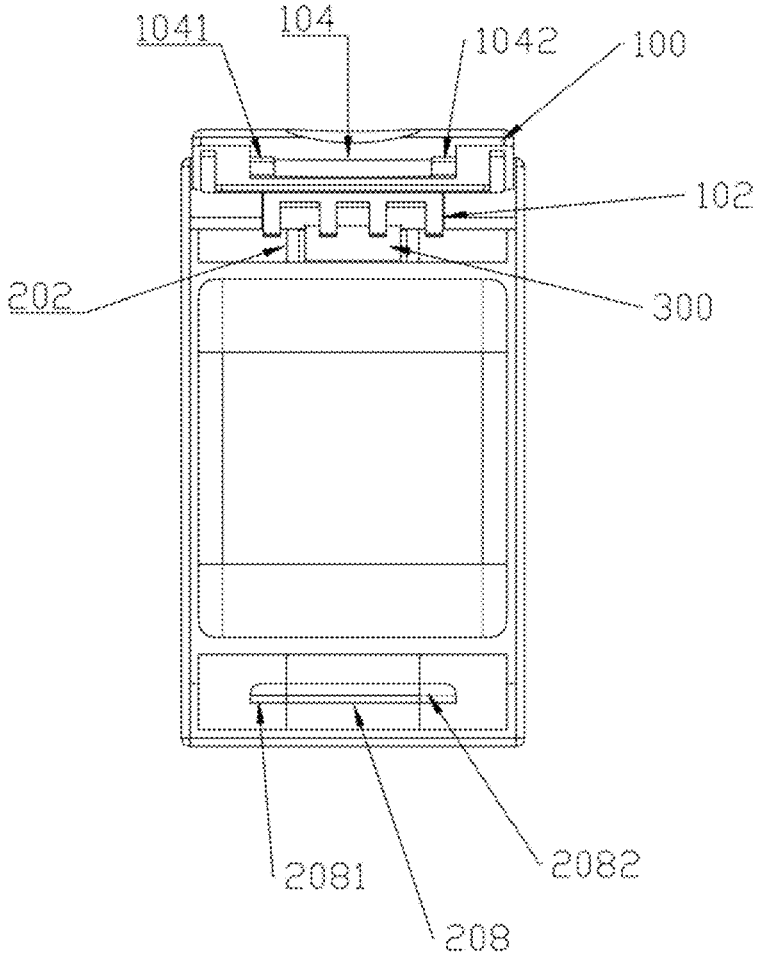
FIG. 5 is a top view of a snap action container according to an embodiment of the present disclosure.
Figure 6:
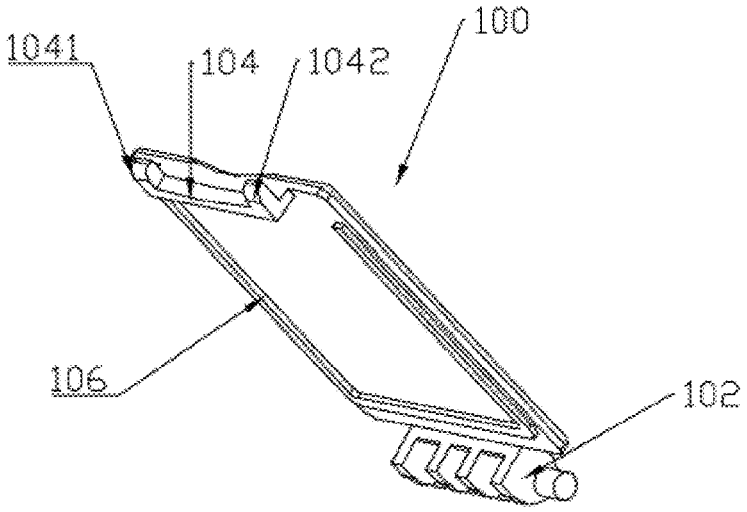
FIG. 6 is a perspective view of a cover plate according to an embodiment of the present disclosure.
Figure 7:
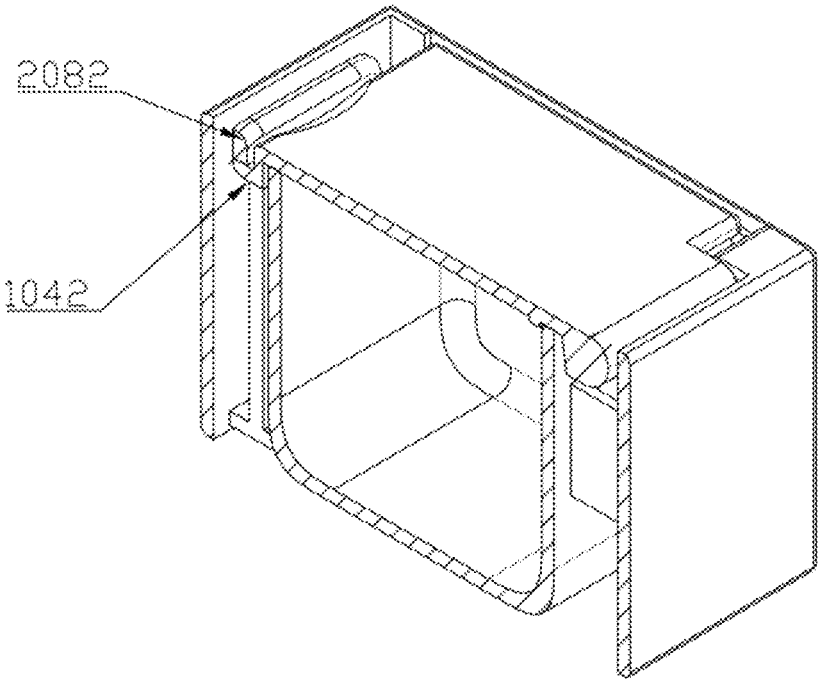
FIG. 7 is a side sectional view of a snap action container according to an embodiment of the present disclosure.

Further, for better engagement between the snap tongue and the snap plate, an embodiment of the present disclosure provides another solution. As illustrated in FIG. 5 and FIG. 6, a first snap tab 1041 and a second snap tab 1042 are respectively arranged on two sides of the snap tongue 104. A first snap block 2081 and a second snap block 2082 are respectively arranged on two sides at one end of the snap plate 208. When the cover plate 100 is covered on the container body 200, the first snap tab 1041 and the second snap tab 1042 are respectively engaged with the first snap block 2081 and the second snap block 2082. When the user presses the cover plate 100, the first snap tab 1041 is abutted against the first snap block 2081, and the second snap tab 1042 is abutted against the second snap block 2082. When the user presses the cover plate 100 with a great force, the first snap block 2081 and the second snap block 2082 are displaced, such that the first snap tab 1041 and the second snap tab 1042 are snapped under the first snap block 2081 and the second snap block 2082. FIG. 7 illustrates a schematic view of engagement between the cover plate 100 and the snap plate 208. In this way, the user may easily open or close the container, and use of the container is convenient.

Furthermore, the snap plate 208 and the snap tongue 104 may be engaged in other fashions. An embodiment of the present disclosure further provides another solution. A snap hole (not illustrated) is arranged on the snap plate. When the cover plate is covered on the container body, the snap tongue is snapped into the snap hole. The snap hole may be arranged at a middle position or on two sides of the snap plate, corresponding to the snap tongue. When being pressed downward, the snap tongue is snapped into the snap hole. In this way, the structure is simple and the use is convenient.

Further, as illustrated in FIG. 6, for the sake of closely covering the cover plate 100 on the container body, according to the present disclosure, a pressing strip 106 is arranged on one side of the cover plate 100, which seals the article receiving chamber.

Figure 8:
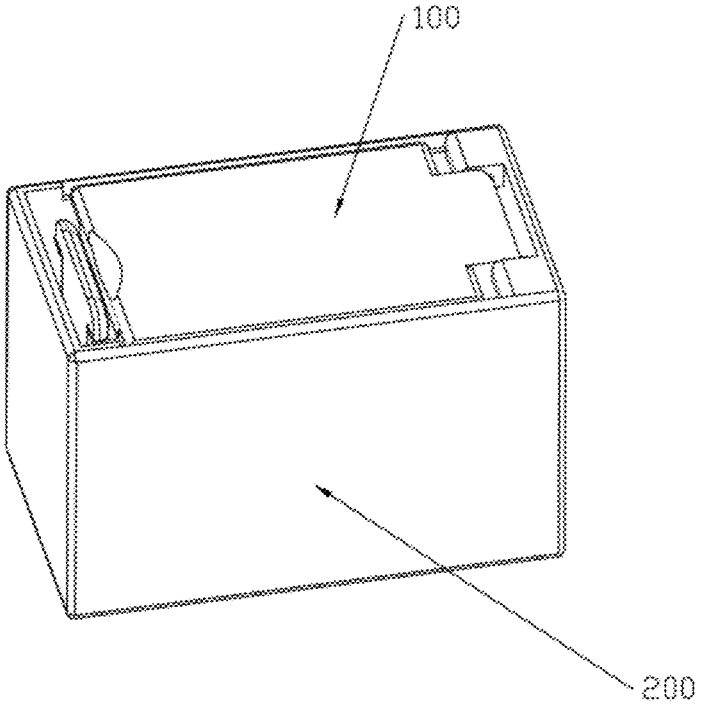
FIG. 8 is a perspective view of a use state of a snap action container according to an embodiment of the present disclosure.

FIG. 8 illustrates a use state of the snap action container according to an embodiment of the present disclosure. The structure of the container is simple, and the operation is convenient. During assembling, the container body, the cover plate, and the elastomer only need to be assembled. In addition, the assembling of the elastomer is very convenient. The assembling is achieved only by placing the elastomer into the elastomer receiving chamber, and then snapping the rotation shaft of the cover plate to the container body. This better solves the problem in the related art.

It should be noted that unless otherwise specified, the technical terms and scientific terms used in the present disclosure shall express general meanings that may be understood by a person skilled in the art.

In the description of the embodiments of the present disclosure, it should be understood that the terms "central," "transversal," "longitudinal," "length," "width," "thickness," "upper," "lower," "front," "rear," "left," "right," "vertical," "horizontal," "top," "bottom," "inner," "outer," "clockwise," "counterclockwise," "axial," "radial," "circumferential," and the like indicate orientations and position relationships which are based on the illustrations in the accompanying drawings, and these terms are merely for ease and brevity of the description, instead of indicating or implying that the devices or elements shall have a particular orientation and shall be structured and operated based on the particular orientation. Accordingly, these terms shall not be construed as limiting the present disclosure.

In addition, terms of "first," "second," and the like are only used for description, but shall not be understood as indication or implication of relative importance or implicit indication of the number of the specific technical features. In the description of the embodiments of the present disclosure, the term "multiple" or "a plurality of" signifies at least two, unless otherwise specified.

In the description of the embodiments of the present disclosure, it should be noted that unless otherwise specified and defined, the terms "mounted," "coupled," "connected," "fixed," and derivative forms thereof shall be understood in a broad sense, which, for example, may be understood as fixed connection, detachable connection or integral connection; may be understood as mechanical connection or electrical connection, or understood as direct connection, indirect connection via an intermediate medium, or communication between the interiors of two elements or interactions between two elements. Persons of ordinary skill in the art may understand the specific meanings of the above terms in the present disclosure according to the actual circumstances and contexts.

In the description of the embodiments of the present disclosure, unless otherwise specified or defined, by defining that a first feature is arranged "above," or "below," or "beneath" a second feature, it means that the first feature is in direct contact with the second feature, or the first feature is in indirect contact with the second feature via an intermediate medium. In addition, by defining that a first feature is arranged "over" or "above" a second feature, it means that the first feature is rightly over the second feature or is obliquely above the second feature, or the horizontal height of the first feature is greater than that of the second feature. In addition, by defining that a first feature is arranged "under," or "blow," or "beneath" a second feature, it means that the first feature is rightly under the second feature or is obliquely below the second feature, or the horizontal height of the first feature is less than that of the second feature.

It should be finally noted that the above-described embodiments are merely for illustration of the present application, but are not intended to limit the present disclosure. Although the present disclosure is described in detail with reference to these embodiments, a person skilled in the art may also make various modifications to the technical solutions disclosed in the embodiments, or make equivalent replacements to a part of or all technical features contained therein. Such modifications or replacement, made without departing from the principles of the present disclosure, shall fall within the scope defined by the claims and the specification of the present disclosure. Especially, various technical features mentioned in various embodiments may be combined in any fashion as long as there is no structural conflict. The present disclosure is not limited to the specific embodiments described herein in this specification, but also includes all the technical solutions falling within the scope subject to the appended claims.

What is claimed is:

1. A snap action container, comprising: a cover plate and a container body; wherein the cover plate is rotatably connected to the container body by a rotation shaft, and covered on the container body;

an elastomer receiving chamber is arranged at a position, corresponding to the rotation shaft, on the container body, an elastomer being inclinedly disposed in the elastomer receiving chamber, and one end of the elastomer being abutted between the rotating shaft and a first side inner wall of the elastomer receiving chamber, wherein a first side of the one end of the elastomer is abutted against the rotation shaft; and a second side of the one end of the elastomer is abutted against the first side inner wall of the elastomer receiving chamber, and when the cover plate is covered on the container body, the cover plate drives the rotation shaft to rotate, such that the rotation shaft presses against the first side of the one end of the elastomer to cause the elastomer to be subjected to elastic deformation;

wherein the rotation shaft comprises a first arc surface and a second arc surface, the first arc surface being smoothly connected to the second arc surface; wherein a rotation radius of the second arc surface is greater than a rotation radius of the first arc surface; and when the cover plate is covered on the container body, the first arc surface and the second arc surface of the rotation shaft are successively in contact with the elastomer, and cause a progressively increasing pressing force against the elastomer.

2. The snap action container according to claim 1, wherein a distance from the first arc surface of the rotation shaft to the first side inner wall of the elastomer receiving chamber is not greater than a thickness of the elastomer.

3. The snap action container according to claim 1, wherein a receiving groove is inclinedly arranged in the elastomer receiving chamber; wherein a first side wall of the receiving groove is formed by a second side inner wall of the elastomer receiving chamber, and a second side wall of the receiving groove is inclined at an angle with respect to a bottom of the receiving groove; wherein one end of the elastomer is arranged in the receiving groove, and the other end of the elastomer is abutted against the rotation shaft.

4. The snap action container according to claim 3, wherein two sides of the receiving chamber are each provided with a baffle, a spacing between the baffles being equal to a width of the elastomer.

5. The snap action container according to claim 4, wherein a plurality of protrusions are arranged on an inner wall of the baffle, the protrusions being configured to restrain the elastomer.

6. The snap action container according to claim 1, wherein the elastomer is a silica gel strip.

7. The snap action container according to claim 6, wherein a snap tongue is arranged at one end of the cover plate; wherein a snap plate receiving chamber is arranged at a position, corresponding to the snap tongue, on the container body, a snap plate being arranged in the snap plate receiving chamber; and when the cover plate is covered on the container body, the snap tongue is engaged with the snap plate, and configured to snap the cover plate to the container body.

8. The snap action container according to claim 7, wherein a first snap tab and a second snap tab are respectively arranged on two sides of the snap tongue; and a first snap block and a second snap block are respectively arranged on two sides at one end of the snap plate;

wherein when the cover plate is covered on the container body, the first snap tab and the second snap tab are respectively engaged with the first snap block and the second snap block.

9. The snap action container according to claim 7, wherein the snap plate is an elastic plate.

10. The snap action container according to claim 3, wherein an inclination angle of the elastomer relative to the bottom of the receiving groove is in a range of 45 degrees to 75 degrees.

11. The snap action container according to claim 3, wherein a bottom of the receiving groove is arranged at a middle position of the elastomer receiving chamber.

12. The snap action container according to claim 3, wherein two sides of the receiving chamber are each provided with a baffle, a spacing between the baffles being slightly smaller than a width of the elastomer.

13. The snap action container according to claim 7, wherein the snap plate receiving chamber and the elastomer receiving chamber are respectively arranged on two sides of the container body, an article receiving chamber being arranged in a middle portion of the container body, and wherein a pressing strip is arranged on one side of the cover plate, which seals the article receiving chamber.

* * * * *